US005104264A

United States Patent [19]

Castagner et al.

[11] Patent Number: 5,104,264

[45] Date of Patent: Apr. 14, 1992

[54] SYSTEM FOR DRIVING ANCHORS IN THE GROUND

[76] Inventors: Bernard Castagner, 4, Chemin des Bourgognes, 77450 Coupvray; Claude Waitzenegger, 20, av. Regnault, 78590 Noisy le Roi, both of France

[21] Appl. No.: 495,915

[22] Filed: Mar. 20, 1990

[30] Foreign Application Priority Data

Mar. 23, 1989 [FR] France ..... 89 03813

[51] Int. Cl.[5] ..... E21B 7/12

[52] U.S. Cl. ..... 405/244; 405/232; 173/28; 173/DIG. 2; 175/135

[58] Field of Search ..... 173/22, 31, 32, 135, 173/139, 28, DIG. 2; 175/135; 405/234, 254, 228, 232, 244; 89/134; 181/113, 114, 116; 227/9, 10; 123/24, 46 H, 46 SC

[56] References Cited

U.S. PATENT DOCUMENTS

Re. 23,569 10/1952 Sopris ..... 227/9
4,286,496 9/1981 Harris ..... 227/9

FOREIGN PATENT DOCUMENTS 039654 11/1981 European Pat. Off. ..... 405/234
073264 9/1983 European Pat. Off. .
1001682 2/1952 France ..... 175/135
1522778 4/1968 France .

*Primary Examiner*—Frank T. Yost
*Assistant Examiner*—C. Dexter
*Attorney, Agent, or Firm*—Sandler, Greenblum & Bernstein

[57] ABSTRACT

Apparatus for driving anchors in the ground by gas pressure which includes on a frame to be maintained stationary relative to the ground, a mechanism for firing and combustion of a pyrotechnical composition, and for launching an anchor. The apparatus including an acoustic shield for gas expansion which is slidingly mounted on a recoil ramp so as to balance the impulse transmitted to the anchor by the force of gravity.

20 Claims, 5 Drawing Sheets

SYSTEM FOR DRIVING ANCHORS IN THE GROUND

BACKGROUND OF THE INVENTION

This invention relates to a system for driving anchors in the ground. At the end of this 20th century, an important evolution occurred in the working conditions on building sites of public works using anchoring and post or pile securing operations.

The technical evolutions concern particularly the following directions: difficult climatics zones (hot or very cold temperatures); specific geological zones (sands, swamps, frozen soils); and steep slope zones or zones which are difficult to reach.

Further, the labor, equipment and device costs become preponderant in the final correct realization of the substructures or underframes. In the present day, some systems, such as foundation drilling or pile ramming, are in many cases difficult to realize and in any case very expensive as concerns the labor and the duration of the works.

On the contrary, the proposed system and its modifications comply to the above mentioned constraints. The proposed system permits there to be obtained anchorings at a high speed in varied grounds or soils, in extreme climatic conditions and difficult geographical or topographical situations. Moreover, the proposed system requires only light equipment and very limited logistics.

SUMMARY OF THE INVENTION

This invention has as its principal object a system for driving anchors in the ground by using pyrotechnical means. The main idea of the anchor pyro-driving system of the invention consists in driving in the ground an anchor, in particular a metallic anchor, on which a superstructure is "secured" by using the energy delivered by a pyro-technical composition e.g. a propergol of the safety type, delivering a great quantity of gases. The generated pressure transmits the principal of the energy to the anchoring element or anchor.

The originality of the conception of the anchor pyro-driving system according to the present invention will be fully discussed below in the detailed description including the drawings. One of the important particularities of the system, which is the object of the invention, is to use, as a recoil weight or mass for ensuring the balancing of the impulses, an acoustic shield or protecting device against the gas expansion which absorbs, in particular by gravity, the recoil or backward energy.

This invention has therefore for an object a system for driving anchors in the ground by expansion of gas, including, on a prop or stand which is to be maintained stationary relative to the ground, a system for the firing and combustion of a pyrotechnical composition, as well as for anchor launching or propulsion. The driving system also includes an acoustic shield for the gas expansion. The gas expansion acoustic shield is mounted slidingly on a recoil ramp or launcher to thereby realize a balancing of the impulse which is transmitted to the anchor.

Advantageously, the prop or stand is constituted by a carrying vehicle associated with unfolding means for moving the recoil ramp and the acoustic shield placed on the ramp, from a transportation position, occupied during transportation on the vehicle, to an operational position. The unfolding means may comprise a telescopic arm mounted on the vehicle by which the recoil ramp may relatively swing from a transportation position to an operational position under the control of a jack actuating the arm.

The acoustic shield is preferably a tube, open at one of its extremities, which is placed, in its operational position, towards the ground, and which is provided, in its interior towards its other extremity, with the firing, combustion and launching mechanism. The tube may be extended, beyond the extremity thereof to be disposed in the direction of the ground during operation, by a flexible skirt. The tube may also include two half-shells which are linked so as to allow the opening of the tube for loading the firing, combustion and launching mechanism.

Also advantageously, the firing, combustion and launching mechanism includes a piston intended to remain solidly affixed with the anchor during its driving; an anchor head defining, with the piston, a combustion chamber; a case for generating gas which is located inside said combustion chamber and containing the pyrotechnical composition; and an anchor lock which is solidly affixed with the acoustic shield. The anchor lock may have two movable jaws or shoes which have for an object to ensure the blocking of the anchor head. The gas generating case may be made of a thermoplastic material or a composite material and its structure may be rendered fragile so as to open at low pressure outside its utilization housing. The pyrotechnical composition may be constituted by a propergol which may be used between −40 ° C. and +70° C.

The anchors may include in particular a penetration limiter and/or vanes or blades for facilitating the driving in the ground.

The following description which will follow is given for an illustrative purpose without any limitation intended. It should be read in relation with the appended drawings.

DETAILED DESCRIPTION OF THE INVENTION

The anchor pyro-driving system according to the invention is preferably constituted by a pyro-driving vehicle, by a supply-truck which is transporting the anchors and may include a handling arm, anchors and gas generators, and possibly a handling vehicle which operates as a shuttle between the pyro-driving vehicle and the supply-truck.

Figure 1:
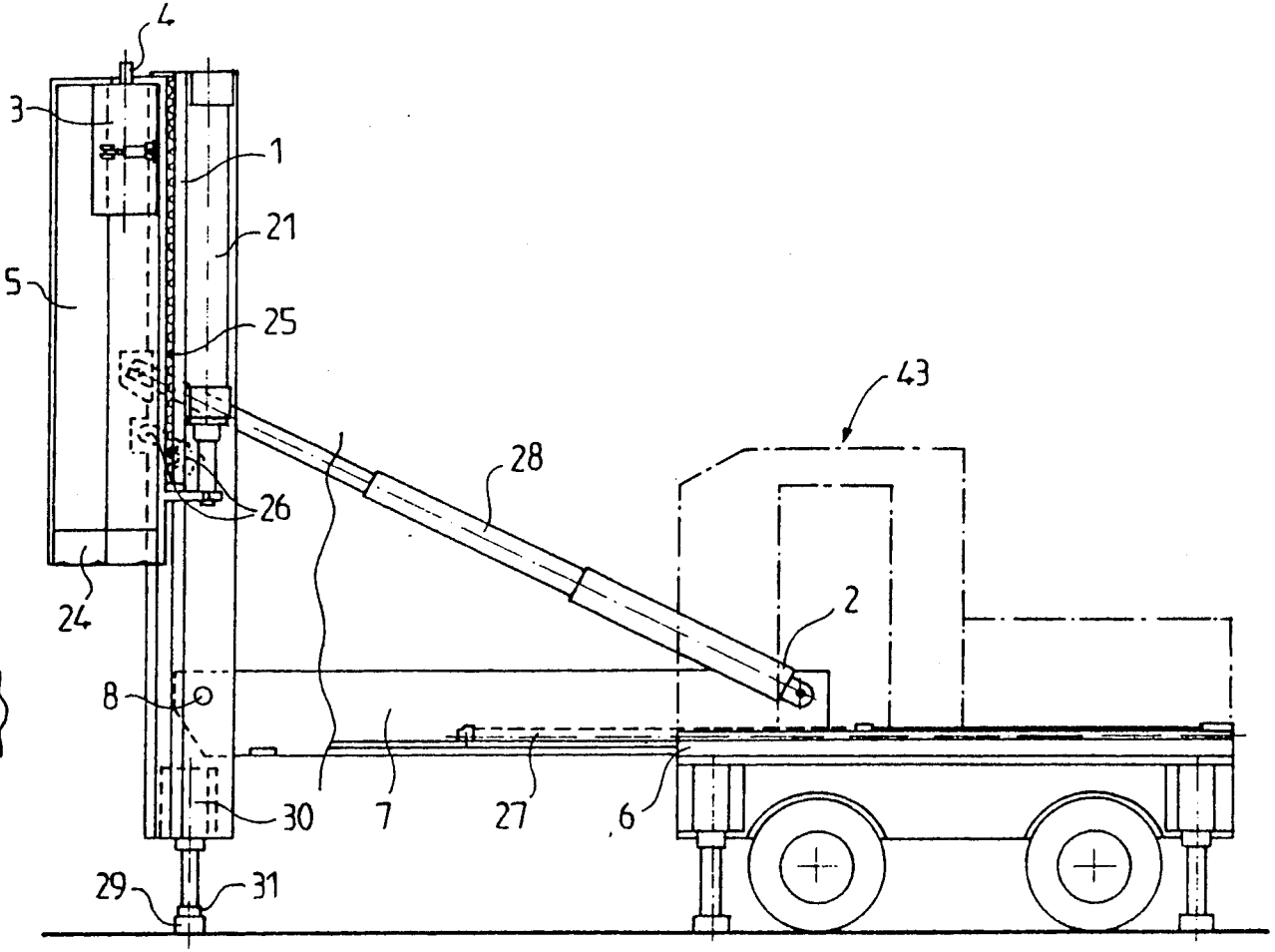
FIG. 1 is a lateral or side view of an apparatus for driving anchors in the ground, according to the invention.

The pyro-driving vehicle is constituted, as shown in FIG. 1, by a recoil ramp 1 and its positioning hydraulic system 2, an hydraulic anchor locker and firing system 4, and an acoustic shield or protecting device against gas expansion 24. All of these elements are mounted on a carrying vehicle 43 which is adapted to the nature of the building site. Without being outside of the scope of the invention, the recoil ramp may be substituted with a recoil gutter or tube; the recoil tube would then have the function of an acoustic shield or protecting device against the gas expansion. The carrying vehicle 43 (FIGS. 7 and 8) may be of the all-grounds type and equipped with a telescopic arm 32 movable in a vertical plane. This allows for the driving of anchors in locations which are situated below or above the level of the carrying vehicle.

For driving-in of small anchors, which does not necessitate a long recoil ramp, the ramp will be placed, according to a feature of the invention, vertically, for example, at the front or the rear of the carrying vehicle. For driving-in bigger anchors, it will generally be necessary to use a longer recoil ramp. For complying with dimensional standards of road transportation, during transportation, the ramp will preferably be placed horizontally. Moreover, the unfolding or spreading out in vertical position will be performed by using mobile arms actuated by jacks, preferably of the hydraulic type.

Figure 2:
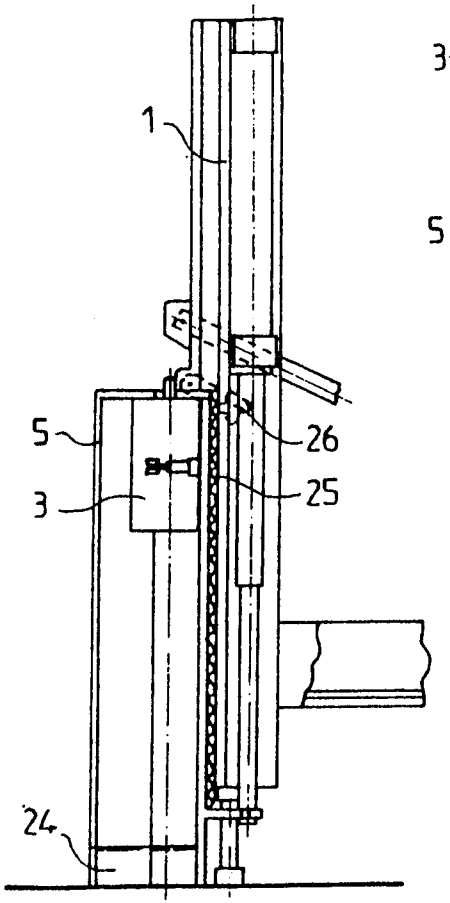
FIG. 2 is a lateral view in detail of the recoil ramp and acoustic shield of the apparatus of FIG. 1.

FIGS. 1 and 2 show a preferred embodiment for the spreading out of the recoil ramp on the pyro-driving vehicle 43. The recoil ramp 1 and its anchoring system are placed on a cradle 7 and connected thereto by a rotation axle 8. The assembly of the cradle 7 and recoil ramp 1 is displaced horizontally along two rails 6 secured to the carrying vehicle by means of the ramp positioning jack 27, so that the rotation axle 8 is correctly located relative to the point where the anchor has to be driven in. The recoil ramp 1 is set upright by extending the upright setting jack 28 which is secured on cradle 7. Two shoes 29 allow for the gripping of the ground by the recoil ramp. They are extended by two jacks 30. The linking 31 of each shoe 29 to its jack arm 30 is, according to a feature of the invention, of the limited motion, knee-joint type in order to allow a good adaptation to the irregularities of the ground without hindering the passage of the anchor when it is driven-in. The control of the driving direction, and therefore of the recoil ramp, is achieved by both the shoes 29 and jack 30 of the recoil ramp, as well as the upright setting jack 28. In particular, the positioning of the recoil ramp from a horizontal position to a vertical position is effected by the upright setting jack 28; whereas, inclination or tilting is effected by the shoes 29 and jack 30.

Without departing from the object of the invention, it is possible to use other unfolding means and embodiments, such as articulated arms set on a jack or jacks or crane arm or arms.

Figure 7:
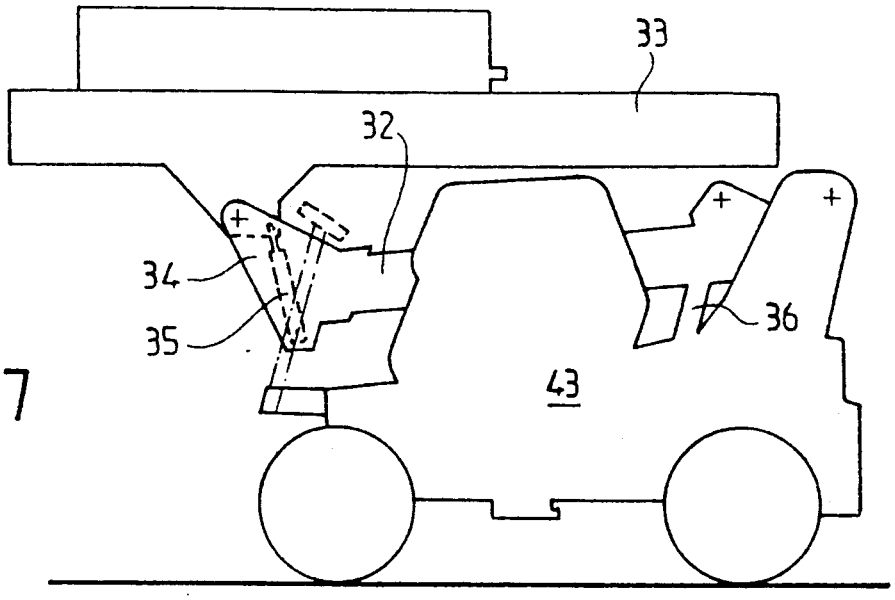
FIGS. 7 and 8 show a modification of the system according to the invention.
Figure 8:
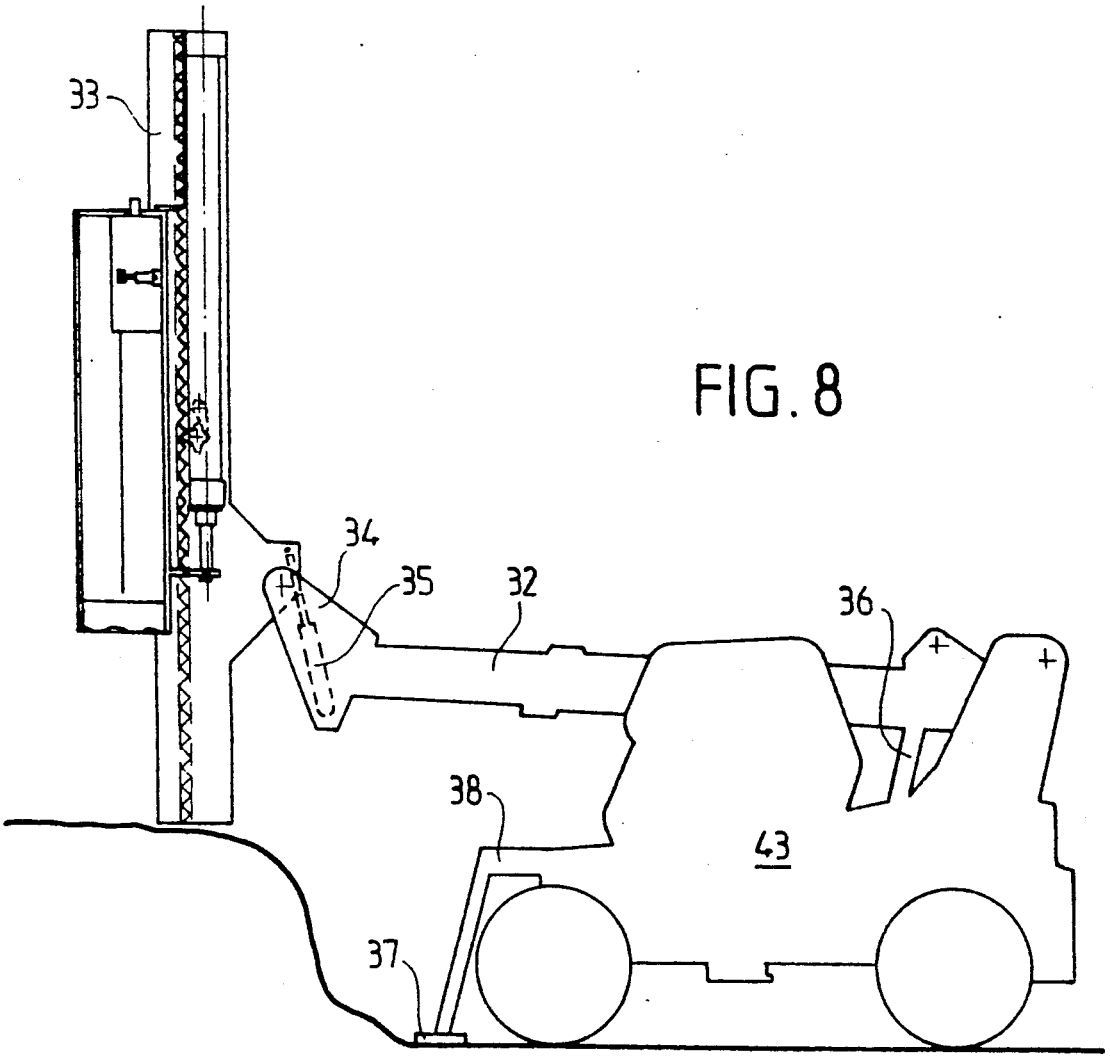
Figure 9:
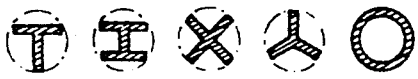
FIGS. 9 through 14 represent the anchoring of the system according to the invention.
Figure 10:
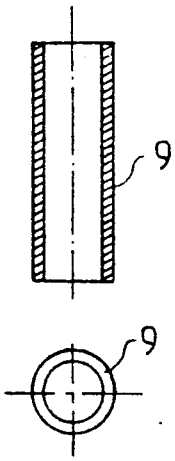
Figure 11:
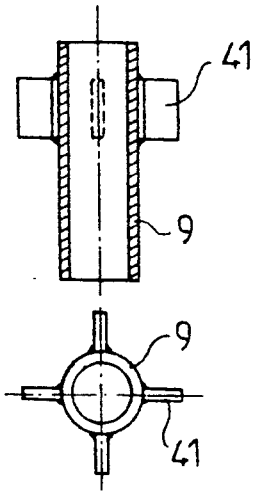
Figure 12:
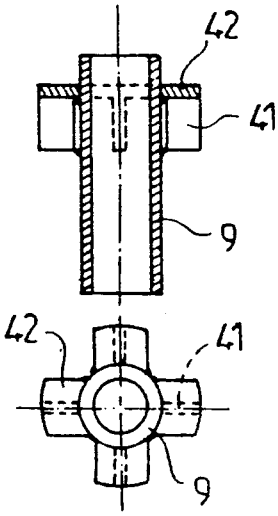
Figure 13:
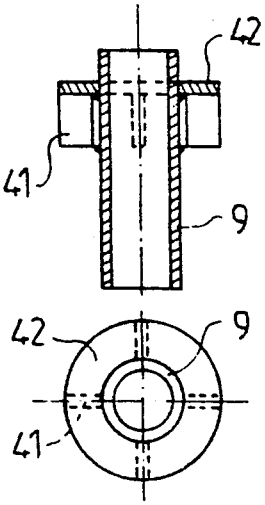
Figure 14:
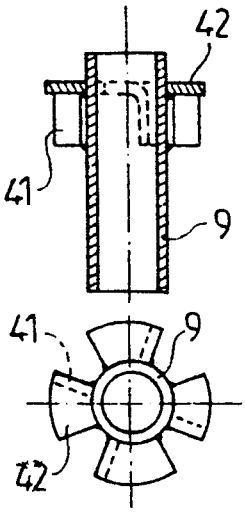

In the preferred embodiment of an all-grounds carrying vehicle equipped with a telescopic arm movable in a vertical plane, FIGS. 7 and 8 show the unfolding means and embodiments of the recoil ramp. The recoil ramp 33 and its anchoring system are bound to the telescopic arm 32 by a "telescoping head" 34 having a jack 35 which allows the swinging of the recoil ramp 33 from the horizontal position for road transportation to the vertical position for use. A jack 36 located between the frame of the carrying vehicle and the telescopic arm 32 allows moving of the arm in a vertical plane. The two shoes 37 and their extending jacks allow improvement in stabilizing the carrying vehicle on the ground, and to compensate for its inclination or tilt resulting from the inequalities of the ground.

Figure 3:
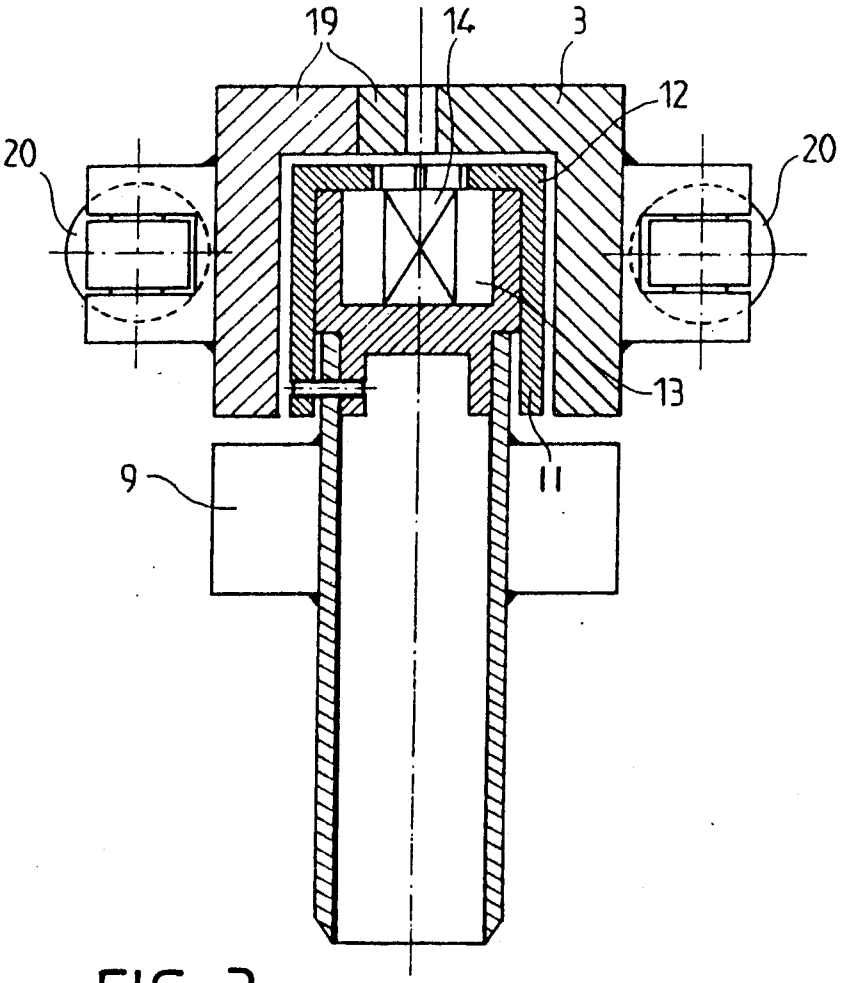
FIG. 3 is a cross section of the firing, combustion and launching system of the driving in system of FIG. 1 taken along a vertical plane in front of hydraulic cylinders 20.

As shown on FIG. 3, for facilitating loading operations of the equipped anchor 9 in the launching system, an anchor launching tube utilizes two parts: an anchor head 12 and an anchor lock 3. The anchor head 12 provides a guide for anchoring and resistance to pressure. The anchor lock 3 provides for a quick and precise grip of the equipped anchor 9, its locking, the precision of the launching axes and the setting in height of the distance to the ground before shooting the equipped anchor. The introduction of the anchor head in the anchor lock 3 may be facilitated by placing under the anchor lock a positioning guide and on the anchor head 12 a rim which will glide on the positioning guide when introducing the anchor. The anchor lock 3, wherein the equipped anchor is lodged, is constituted by two jaws or shoes 19. These jaws are easily interchangeable for dealing with anchor heads having various diameters to permit driving of different sized anchors with the same pyro-driving-in vehicle. The jaws are actuated by hydraulic jacks 20. It is also possible to use a single jack acting on both jaws. The anchor lock 3 is moved along the recoil ramp 1 by a hydraulic jack 21. The anchor 9 is equipped with a reusable piston 11 and a reusable anchor head 12. The combustion chamber 13, which is so formed, contains the gas generator 14 which for safety reasons is placed in the chamber 13 preferably when the equipped anchor is placed in the pyro-driving-in system. The closing of the chamber 13 is realized by means of a quick-closing lock.

The fluid-tightness of chamber 13 and the precision of the initial guidance of anchor 9 equipped with its piston 11 are provided by the machining precision of the anchor head 12 and of the piston 11 which both may be used several times. For economical reasons, the external "diameter" of the consummable anchor is rough as resulting from manufacture. The guidance length of piston 11 prevents the jamming of the equipped anchor during its motion, which is an advantage which would not be provided by a simple rest plate, with or without a seam. Piston 11 is disposed internally in the anchor head for facilitating the automatic and precise prehension gripping thereof in the anchor lock. The assembly of the anchor, piston and anchor head is realized by simple journal connection.

Figure 6:
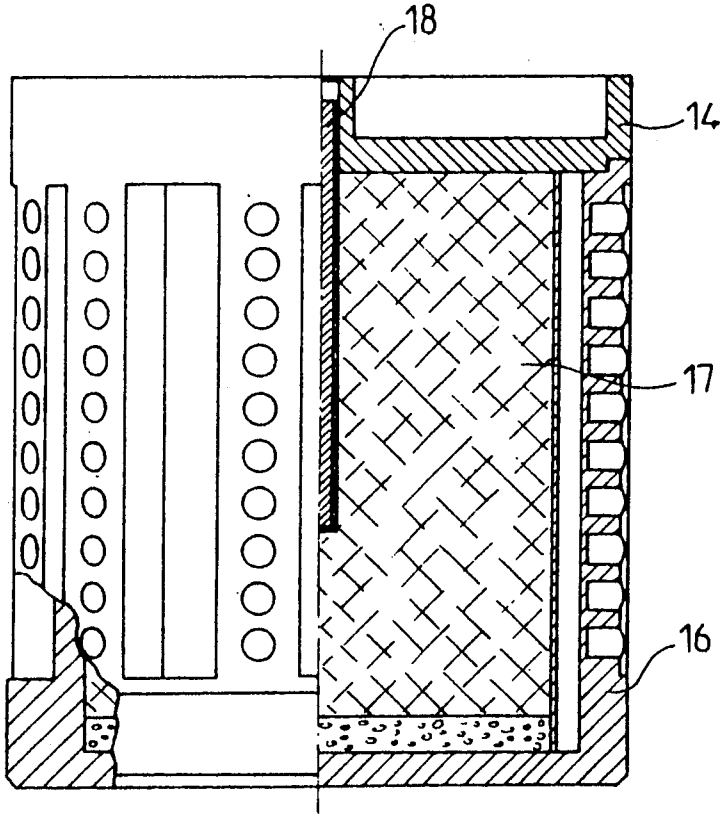
FIGS. 5 and 6 are cross sections of the gas generating system of FIG. 1.
Figure 5:
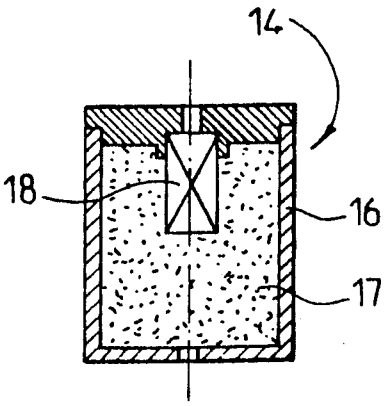

As shown in FIGS. 5 and 6, the gas generator 14 includes a fluid-tight case 16, preferably of composite or thermoplastic material, with or without obturated vent-holes or flash-holes. The structure of the gas generator may also be realized in metal, in cardboard, in composite material or in a combination of such materials. The plastic materials have been selected so that, in case of fire, the structural material is rendered fragile at a temperature lower than the self-inflammation temperature of the pyrotechnical products. The structure of the case 16 of the gas generator 14 remains unharmed when the gas generator is operating, but it may be also burn or burst when functioning. The preferred solution limits the combustion and functioning residues and allows the use of a powder with a high combustion pressure without generating such high pressures in the thrust chamber. Such high pressures would apply too high accelerations on the anchors and dimensional constraints on the walls of the thrust chamber. In order to provide a mechanical resistance of the structure during operation, it is preferable to prop a part thereof on the walls of the housing of the generator. For safety reasons during transportation and storage, it is advantageous to permit the gas generator to open under low pressure, if an unexpected firing thereof takes place.

As illustrated in FIG. 3, the neck or upper part of the combustion chamber is preferably connected to the structure of the gas generator, but it may also be connected to the structure of the housing of the gas generator by means of an element which is interchangeable after a great number of launchings. The neck of the chamber is constituted by at lest one hole. The holes are cylindrical or convergent in order to limit the speed of the gases which would be detrimental to the output of the gas generator system; without departing from the scope of the invention, there may be utilized a hole including, in its volume, a diverging portion. In particular for allowing the conditioning of all shapes of propergol elements before and after the combustion, a generator with a number of small orifices will be used. The obturation of these many orifices is preferentially obtained by using a lower thickness of material at the level of these orifices (FIG. 6). Still remaining in the field of the invention, one may utilize other systems as a thin internal double wall, an aluminized adhesive, etc. This case contains the "all-weather" type propergol 17, for reasons of safety and operation regularity between −40° C. and +70° C. Without departing from the invention, one may use other types of pyrotechnical compositions.

The firing is provided by a pyrotechnical component 18 ignited or initiated by a laser, or by a pyrotechnical component with the pyrotechnical component being ignited or initiated by percussion. It is also possible to use electric igniters which are not responsive to stray electric currents or electromagnetic radiations and to static electricity. The use of a pyrotechnical component ignited by a laser permits the avoidance of fluid-tightness problems and the problems of a precise positioning between the cartridge-bag containing pyrotechnical component 18 and the firing initiation system. Further, insensitivity of the pyrotechnical component 18 to impacts and to various environments is increased. The firing initiation system includes an interruption of the initiation sequence which is also called an initiation safety device. This system integrates, in case of functioning interdiction, the various safety data, such as the verticality (measured by vertically pick-ups), the closing of the anchor lock and the closing of the acoustic shield.

Figure 4:
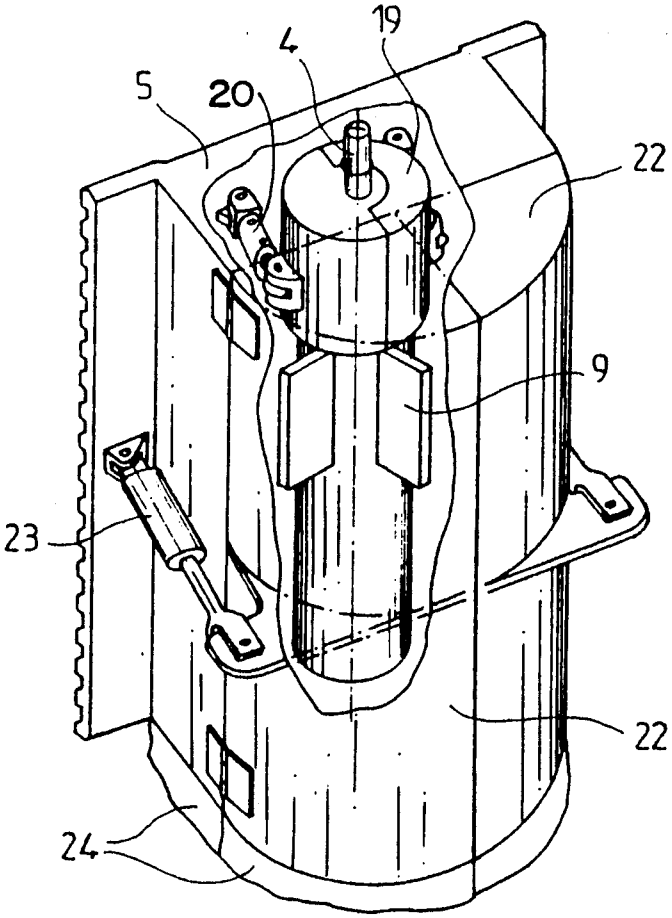
FIG. 4 is a perspective view in detail of the acoustic shield of the apparatus of FIG. 1.

As shown on FIG. 4, the acoustic and gaseous effects of the expansion of the gas from the gas generator are preferably limited by using an acoustic shield wherein the gases are over expanded.

For facilitating the loading operations of the equipped anchors 9, for visually checking the conformity of the loading and for limiting the height of the recoil ramp, there is utilized an acoustic shield which may be opened, e.g., a shield constituted by half-shells 22, the weight or masses of which are balanced on each side of the anchoring system. These two half-shells 22 are closed by means of jacks 23 after loading of the equipped anchor 9 in the anchor lock 3. It is also possible to use:

an acoustic shield composed of flexible materials which is lifted during loading;

extendible rigid elements which are effectively fitted compactly within one another during loading;

a rigid acoustic shield in a single element which is disengaged by lifting along the recoil ramp, independently of the anchor lock. The acoustic shield is equipped at the base thereof with a flexible skirt 24 which ensures a certain amount of fluid-tightness at ground level, despite irregularities of the ground.

The balancing of the impulse transmitted to the anchor and its piston is provided by the lifting, along the recoil ramp, of the anchor lock, of the anchor head and of the acoustic shield, the assembly which will be called hereinafter the recoil mass or weight.

If designating by e the energy transmitted to the anchor and its piston, m the mass of the anchor and its piston, M the recoil mass, h the height of recoil and g the gravity constant, the impulse law and the relationships between the kinetic and potential energies allow the following equality:

$$h = \frac{em}{gM^2}$$

When the recoil mass has reached a height h corresponding to a speed thereof equal to zero, it will be locked as soon as it starts to fall back by a system constituted by rack 25 and pawl 26 (see FIG. 1). This simple and reliable system limits the linking efforts between the recoil mass and the recoil ramp.

The control of the fall of the recoil mass is according to a feature of the invention, provided by the hydraulic jack 21 of the ramp, which disengages pawl 26 from rack 25.

However, it is possible to lock or damp the fall of the recoil mass by other means, such as a pneumatic or hydraulic damper.

The operational and working diagram is described hereinunder.

Placing into operational position: driving the vehicles to reach the location where the anchoring has to be performed (the pyro-driving-in vehicle is capable to perform an anchoring at about 4 to 5 meters from the vehicle according to the equipment thereof); swinging of the recoil ramp and of the anchoring system from the horizontal transport position to the vertical working position; simultaneously opening the two jaws of the anchor lock and of the half-shells of the acoustic shield.

Loading operations: Choosing the anchor corresponding to the ground or soil; placing the gas generator in position and closing the safety lock on the anchor head; loading the anchor; closing the anchor lock; closing the acoustic (environmental) shield.

Placing into position steps: bringing the recoil ramp and the anchoring system in the operational location; setting the verticality of the system; lowering the anchoring system until contact of the acoustic shield with the ground.

Firing and of the equipped anchor: suppressing the firing safety element; cocking the firing system; liberating the energy of firing (radiation or percussion) initiating the safety igniter; combustion of the propergol, thereby providing a pressure increase in the generator, then total or partial breaking of the structure of the generator and expansion of gases in the anchor head; the liberated energy is transmitted to a) the anchor through the piston and b) the recoil mass which climbs along the recoil ramp.

Motion of the anchor: the anchor moves at high speed; at the end of its travel in the anchor head, the anchor has reached its maximal speed and is driven in the ground; its kinetic energy is absorbed by friction produced by the penetration in the soil; the penetration height is obtained by using in the generator various loads which are a function of the nature of the soil constituting the ground and of the type of anchor; if it desired to have a precise penetration depth or limit the number of types of gas generators, penetration limiters (stopping plates or segments) are placed on the exterior of the tubes.

Motion of the recoil mass: The kinetic energy of the anchoring system (anchor head and acoustic shield) has been absorbed during its climbing along the recoil ramp; at the end of its travel, the anchoring system is blocked in "high position" by the locking system with ratchet and pawl; in high position, the acoustic shield has uncoupled the ungrounded part of the anchor and the piston which can be reused; the pyro-driving-in vehicle is moved from the spot and the anchoring head is recovered.

Then everything is ready for a new cycle loading-anchoring.

It will be easily understood that without departing from the invention, modifications may be made to these operational steps of the pyro-driving-in device.

The anchors 9 may be driven in soils of very different types, as sand, swamps, clay, limestone etc. The anchors, which are preferentially metallic anchors, may be of various shapes and dimensions depending on the nature of the soil and of the forces applied to the anchor during driving in the soil (see FIGS. 9 to 14).

The anchors 9 may include lateral vanes 4 which improve the anchoring in the ground, in particular the resistance to swinging forces.

The anchors may also be equipped with penetration limiters, constituted by circular or polygonal plates or added elements which may be welded or bent.

The profiles in section of the various anchors are adapted to the nature of the soil; they may be cylindrical, polygonal, in the shape of the letters "T" or "H" or of the addition sign "+" etc . . .

Elements allowing for a quick securing of the structures of these anchors may be integrated to the anchors; for example, an encasing tube or cone, a securing lug, or a prewelded bolt.

We claim:

1. An apparatus for driving anchors in the ground by gas pressure delivered by firing and combustion of a pyrotechnical composition, said apparatus comprising:

a support;

a fixed recoil ramp mounted on said support;

an acoustic shield providing for expansion of combustion gases, said acoustic shield being movable along the length of said fixed recoil ramp upwardly against gravity, so as to obtain a balancing of upward recoil force; and launching means for launching an anchor towards the ground, said launching means being affixed on said acoustic shield.

2. The apparatus according to claim 1, wherein said support comprises a carrying-vehicle including deployment means for moving said fixed recoil ramp and said acoustic shield between a transportation position on said carrying-vehicle to an operational position.

3. The apparatus according to claim 2, wherein said deployment means include a telescopic arm on which is mounted a swinging element associated with said fixed recoil ramp to permit said recoil ramp to swing from a transportation position to an operational position under the action of at least one jack associated with said telescopic arm.

4. The apparatus according to claim 2, wherein said acoustic shield comprises a tube having a closed end and an opened end, said open end is capable of being directed towards the ground in the operational position, and said tube containing in its interior, at a location proximate to the closed end, said launching means.

5. The apparatus according to claim 4, wherein said acoustic shield includes a flexible skirt on its open end.

6. The apparatus according to claim 1, wherein said acoustic shield comprises a tube having a closed end and an opened end, said open end is capable of being directed towards the ground in the operational position, and said tube containing in its interior, at a location proximate to the closed end, said launching means.

7. The apparatus according to claim 6, wherein said acoustic shield includes a flexible skirt on its open end.

8. The apparatus according to claim 7, wherein said tube includes two half shells, said two half shells being journaled and affixed so as to enable opening of said tube when loading the apparatus.

9. The apparatus according to claim 6, wherein said tube includes two half shells, said two half shells being journaled and affixed so as to enable opening of said tube when loading the apparatus.

10. The apparatus according to claim 6, wherein said launching means comprise:

a piston which remains solidly affixed to the anchor when driving the anchor into the soil;

an anchoring head, said anchoring head defining with said piston a combustion chamber;

a casing for gas generation, said casing being located in said combustion chamber and containing a pyrotechnical composition; and an anchoring lock solidly affixed to said acoustic shield, with said anchoring lock surrounding said anchoring head.

11. The apparatus according to claim 10, wherein said anchoring lock comprises two movable jaws that ensure blocking of said anchoring head.

12. The apparatus according to claim 10, wherein said casing for said gas generator comprises a thermoplastic or composite material having a fragile structure.

13. The apparatus according to claim 6, further including an anchor which includes at least one penetration limiter.

14. The apparatus according to claim 1, wherein said launching means comprise:

a piston which remains solidly affixed to the anchor when driving the anchor into the soil;

an anchoring head, said anchoring head defining with said piston a combustion chamber;

a casing for gas generation, said casing being located in said combustion chamber and containing a pyrotechnical composition; and an anchoring lock solidly affixed to said acoustic shield, with said anchoring lock surrounding said anchoring head.

15. The apparatus according to claim 14, wherein said anchoring lock comprises two movable jaws that ensure blocking of said anchoring head.

16. The apparatus according to claim 14, wherein said casing for said gas generator comprises a thermoplastic or composite material having a fragile structure.

17. The apparatus according to claim 14, wherein said anchor includes stabilization vanes for stabilization of said anchor within the ground.

18. The apparatus according to claim 1, further including an anchor which includes at least one penetration limiter.

19. The apparatus according to claim 18, wherein said anchor includes stabilization vanes for stabilization of said anchor within the ground.

20. The apparatus according to claim 1, further including means for holding said acoustical shield at an upper position on said fixed recoil ramp after upward movement of said acoustical shield against gravity.

* * * * *